US008130167B2

(12) United States Patent
Glabe et al.

(10) Patent No.: US 8,130,167 B2
(45) Date of Patent: Mar. 6, 2012

(54) RADOMES, AIRCRAFT AND SPACECRAFT INCLUDING SUCH RADOMES, AND METHODS OF FORMING RADOMES

(75) Inventors: John R. Glabe, Ramona, CA (US); Andrew B. MacFarland, Beavercreek, OH (US); Paul C. Kuhl, Vista, CA (US); Thomas Barrett Jackson, Portland, OR (US)

(73) Assignee: COI Ceramics, Inc., San Diego, CA (US)

( * ) Notice: Subject to any disclaimer, the term of this patent is extended or adjusted under 35 U.S.C. 154(b) by 306 days.

(21) Appl. No.: 12/422,075

(22) Filed: Apr. 10, 2009

(65) Prior Publication Data

US 2011/0050516 A1 Mar. 3, 2011

(51) Int. Cl.
*H01Q 1/42* (2006.01)
*H01Q 1/28* (2006.01)

(52) U.S. Cl. ..... 343/872; 343/705

(58) Field of Classification Search ..... 343/872, 343/873, 705

See application file for complete search history.

(56) References Cited

U.S. PATENT DOCUMENTS 3,292,544 A * 12/1966 Caldwell et al. ..... 343/872
3,925,783 A 12/1975 Bleday et al.
4,148,039 A 4/1979 Lunden
4,179,699 A 12/1979 Lunden
4,180,605 A 12/1979 Gilbert et al.
4,358,772 A 11/1982 Leggett
4,364,884 A 12/1982 Traut
4,451,833 A 5/1984 Traut
4,506,269 A 3/1985 Greene
4,520,364 A 5/1985 Perry
4,615,859 A 10/1986 Traut
4,615,933 A 10/1986 Traut
4,620,890 A 11/1986 Myers et al.
4,659,598 A 4/1987 Traut
4,677,443 A 6/1987 Koetje et al.
4,725,475 A 2/1988 Fiscus et al.
4,797,683 A 1/1989 Kosowsky et al.
4,949,095 A 8/1990 Neil et al.
4,983,422 A 1/1991 Davis et al.
5,129,990 A 7/1992 Binnie, Jr. et al.
5,140,338 A 8/1992 Schmier et al.
5,182,155 A 1/1993 Roe
5,395,648 A 3/1995 Davis et al.
5,400,043 A 3/1995 Arceneaux et al.

(Continued)

OTHER PUBLICATIONS

Rudge, A. W., et al., The Handbook of Antenna Design, vol. 2, Chapter 14, © 1983 Peter Peregrinus Ltd., London, UK.

(Continued)

*Primary Examiner* — Hoang V Nguyen
(74) *Attorney, Agent, or Firm* — TraskBritt

(57) ABSTRACT

Radomes include an outer wall having a first average thickness and an inner wall having a second average thickness that is different from the first average thickness. At least a major portion of the inner wall is separated from at least a major portion of the outer wall by a space therebetween. The outer wall may comprise a layer of ceramic matrix composite (CMC) material. Aircraft and spacecraft include such radomes. Methods of forming radomes include forming an outer wall having a first average thickness, forming an inner wall having a different second average thickness, and coupling together the inner wall and the outer wall in such a manner as to provide a space between at least a major portion of the outer wall and at least a major portion of the inner wall.

45 Claims, 4 Drawing Sheets

U.S. PATENT DOCUMENTS

| | | | | |
|---|---|---|---|---|
| 5,408,244 | A | | 4/1995 | Mackenzie |
| 5,457,471 | A | | 10/1995 | Epperson, Jr. |
| 5,569,422 | A | * | 10/1996 | Astier et al. ..... 156/89.11 |
| 5,589,115 | A | * | 12/1996 | Sherwood ..... 156/89.26 |
| 5,600,325 | A | | 2/1997 | Whelan et al. |
| 5,650,249 | A | * | 7/1997 | Dull et al. ..... 430/5 |
| 5,652,631 | A | | 7/1997 | Bullen et al. |
| 5,691,736 | A | * | 11/1997 | Hunn et al. ..... 343/872 |
| 5,707,723 | A | | 1/1998 | Harrison et al. |
| 5,758,845 | A | | 6/1998 | Sunne et al. |
| 5,820,077 | A | | 10/1998 | Sutliff et al. |
| 5,849,234 | A | | 12/1998 | Harrison et al. |
| 5,884,864 | A | | 3/1999 | Sunne et al. |
| 5,958,557 | A | | 9/1999 | Naor |
| 6,028,565 | A | | 2/2000 | Mackenzie et al. |
| 6,087,971 | A | | 7/2000 | Clarke et al. |
| 6,091,375 | A | * | 7/2000 | Goto et al. ..... 343/872 |
| 6,094,054 | A | | 7/2000 | Crist |
| 6,107,976 | A | * | 8/2000 | Purinton ..... 343/872 |
| 6,184,842 | B1 | | 2/2001 | Leinweber et al. |
| 6,323,825 | B1 | | 11/2001 | Zidek et al. |
| 6,335,699 | B1 | | 1/2002 | Honma |
| 6,433,753 | B1 | | 8/2002 | Zimmermann |
| 6,476,771 | B1 | | 11/2002 | McKinzie, III |
| 6,497,776 | B1 | | 12/2002 | Butler et al. |
| 6,518,936 | B1 | | 2/2003 | Dull |
| 6,639,567 | B2 | | 10/2003 | Chang et al. |
| 6,788,273 | B1 | | 9/2004 | Schultz et al. |
| 6,918,985 | B2 | | 7/2005 | Geyer |
| 6,975,279 | B2 | | 12/2005 | Delgado et al. |
| 6,992,640 | B2 | | 1/2006 | Usami et al. |
| 7,006,052 | B2 | | 2/2006 | Delgado et al. |
| 7,030,834 | B2 | | 4/2006 | Delgado et al. |
| 7,151,504 | B1 | | 12/2006 | Boatman et al. |
| 7,420,523 | B1 | | 9/2008 | Ziolkowski et al. |
| 7,463,212 | B1 | | 12/2008 | Ziolkowski |
| 7,682,700 | B2 | * | 3/2010 | Sambasivan et al. ..... 428/426 |
| 2005/0024289 | A1 | | 2/2005 | Fredberg et al. |
| 2006/0044189 | A1 | | 3/2006 | Livingston et al. |
| 2008/0136731 | A1 | | 6/2008 | Wu et al. |
| 2008/0186250 | A1 | | 8/2008 | Wolf et al. |
| 2008/0316140 | A1 | | 12/2008 | Wu et al. |

OTHER PUBLICATIONS

Skolnik, M. I., Introduction to Radar Systems, Chapter 7, © 1980 McGraw-Hill, New York, N.Y.

International Search Report, International Application No. PCT/US2010-020130, mailed Nov. 3, 2010, three (3) pages.

Written Opinion of the International Searching Authority, International Application No. PCT/US2010/020130, mailed Nov. 3, 2010, four (4) pages.

* cited by examiner

RADOMES, AIRCRAFT AND SPACECRAFT INCLUDING SUCH RADOMES, AND METHODS OF FORMING RADOMES

GOVERNMENT RIGHTS

This invention was made with government support under Contract No. N68936-07-C-0007 awarded by the Department of the Navy. The government has certain rights in the invention.

TECHNICAL FIELD

The present invention, in various embodiments, relates to radomes for protecting antennas from environmental conditions, to aircraft and spacecraft carrying such radomes, and to methods of manufacturing radomes.

BACKGROUND

Radomes are structures that are used to protect antennas (e.g., radar antennas) and associated equipment from environmental exposure. Thus, radomes may be subject to both physical and electromagnetic requirements and specifications. For example, radomes are often used in various types of aircraft and missiles carrying radar equipment, and such radomes must be aerodynamic and capable of withstanding physical and thermal stresses encountered during flight. Radomes also are typically subject to electromagnetic performance requirements and specifications such as, for example, minimum transmission loss, minimum reflected power, minimum beam deflection, and minimum pattern distortion. There is often a trade-off in the design of a radome between physical performance requirements and electromagnetic performance requirements.

The term "radome" was derived from the terms "radar" and "dome," although, as used herein, the term "radome" means and includes any structure configured to protect an antenna from environmental exposure and through which electromagnetic radiation is transmitted to or from the antenna. Radomes may have any shape or configuration, and are not limited to dome-shaped structures, and may be configured to transmit any range of frequencies of electromagnetic radiation therethrough.

There are many different materials used in constructing radomes and many different cross-sectional radome configurations including single layer (often referred to in the art as "monolithic" or "solid-wall" configurations) and multi-layer or "sandwich" configurations including, for example, what are known in the art as "A-sandwich" radome configurations, "B-sandwich" radome configurations, and "C-sandwich" radome configurations. Such radome configurations are discussed in, for example, A. W. Rudge, K. Milne, A. D. Olver, and P. Knight, eds., THE HANDBOOK OF ANTENNA DESIGN, Vol. 2, Chapter 14, Peter Peregrinus Ltd., London, and M. I. Skolnik, INTRODUCTION TO RADAR SYSTEMS, Chapter 7, McGraw-Hill, New York, N.Y.

The "A-sandwich" radome configuration includes a relatively thick inner core that is sandwiched between two relatively thin outer "skin" layers. The inner core is formed of a material that exhibits a low dielectric constant (e.g., a foam material, or a honeycomb structure), and the outer skin layers are formed of a material that exhibits a relatively high dielectric constant. The dielectric constant of the core may be less than the square root of the dielectric constant of the skin layers. The dielectric constant of the core may be reduced by reducing the density of the core material (e.g., by increasing porosity in the core material).

The "B-sandwich" radome configuration includes a relatively thin inner core that is sandwiched between two relatively thick outer skin layers. The inner core is formed of a material that exhibits a relatively high dielectric constant, and the outer skin layers are formed of a material that exhibits a relatively low dielectric constant. The dielectric constant of the core may be greater than the square of the dielectric constant of the skin layers. B-sandwich radomes may exhibit higher power transmission efficiencies relative to A-sandwich radomes, but the physical properties exhibited by the materials of the outer skin layers in B-sandwich configurations may not withstand the conditions experienced in high-temperature, high-velocity applications such as those encountered by radomes on missiles.

What is referred to in the art as a "C-sandwich" radome configuration consists of two contiguous A-sandwiches. In other words, a C-sandwich radome includes two "core" layers that exhibit a relatively low dielectric constant that are separated from one another by a central skin layer. An outer skin layer is also disposed on the outer surface of each core layer, and the exposed major surfaces of these outer skin layers provide the interior and exterior surfaces of the radome. Sensitivity to frequency, incident angle, and polarization may be reduced in the C-sandwich radome configuration relative to the A-sandwich and B-sandwich radome configurations.

Radomes that are lightweight, physically strong, tough, and wear-resistant, and that exhibit desirable electromagnetic performance characteristics continue to be sought for use on aircraft and spacecraft.

BRIEF SUMMARY OF THE INVENTION

In some embodiments, the present invention includes radomes that include an outer wall having a first average thickness and an inner wall having a second average thickness that is different from the first average thickness. At least a major portion of the inner wall is separated from at least a major portion of the outer wall by a space therebetween. The outer wall may comprise a layer of ceramic matrix composite (CMC) material.

In additional embodiments, the present invention includes air vehicles and space vehicles including such radomes. For example, one embodiment of a vehicle of the present invention includes an antenna for emitting electromagnetic radiation over a range of frequencies, and a radome at least partially covering the antenna. The radome includes an outer wall having a first average thickness and an inner wall having a different second average thickness. At least a major portion of the inner wall is separated from at least a major portion of the outer wall by a space. The outer wall may comprise a layer of ceramic matrix composite (CMC) material.

In additional embodiments, the present invention includes methods of forming radomes in which an outer wall that has a first average thickness is formed, an inner wall that has a different second average thickness is formed, and the inner wall and the outer wall are coupled together in such a manner as to provide a space between at least a major portion of the outer wall and at least a major portion of the inner wall. Each of the outer wall and the inner wall may be formed to have a dome shape, and the inner wall may be at least partially inserted into an inner dome area enclosed by the outer wall. At least the outer wall may be formed to comprise a ceramic matrix composite (CMC) material.

BRIEF DESCRIPTION OF THE SEVERAL VIEWS OF THE DRAWINGS

While the specification concludes with claims particularly pointing out and distinctly claiming embodiments of the present invention, the advantages of this invention can be more readily ascertained from the following description of the invention when read in conjunction with the accompanying drawings in which:

DETAILED DESCRIPTION OF THE INVENTION

In some embodiments, the present invention includes aircraft and spacecraft that carry one or more radomes, as described herein. As used herein, the term "aircraft" means and includes any device, apparatus, system, or vehicle designed and constructed for traveling through the air substantially within the Earth's atmosphere. As used herein, the term "spacecraft" means and includes any device, apparatus, system, or vehicle designed and constructed for traveling through space outside the Earth's atmosphere, although spacecraft may also travel through the Earth's atmosphere upon entering and/or exiting space. Aircraft and spacecraft include, for example, airplanes, rockets, missiles, space vehicles, satellites, space stations, etc.

Figure 1:
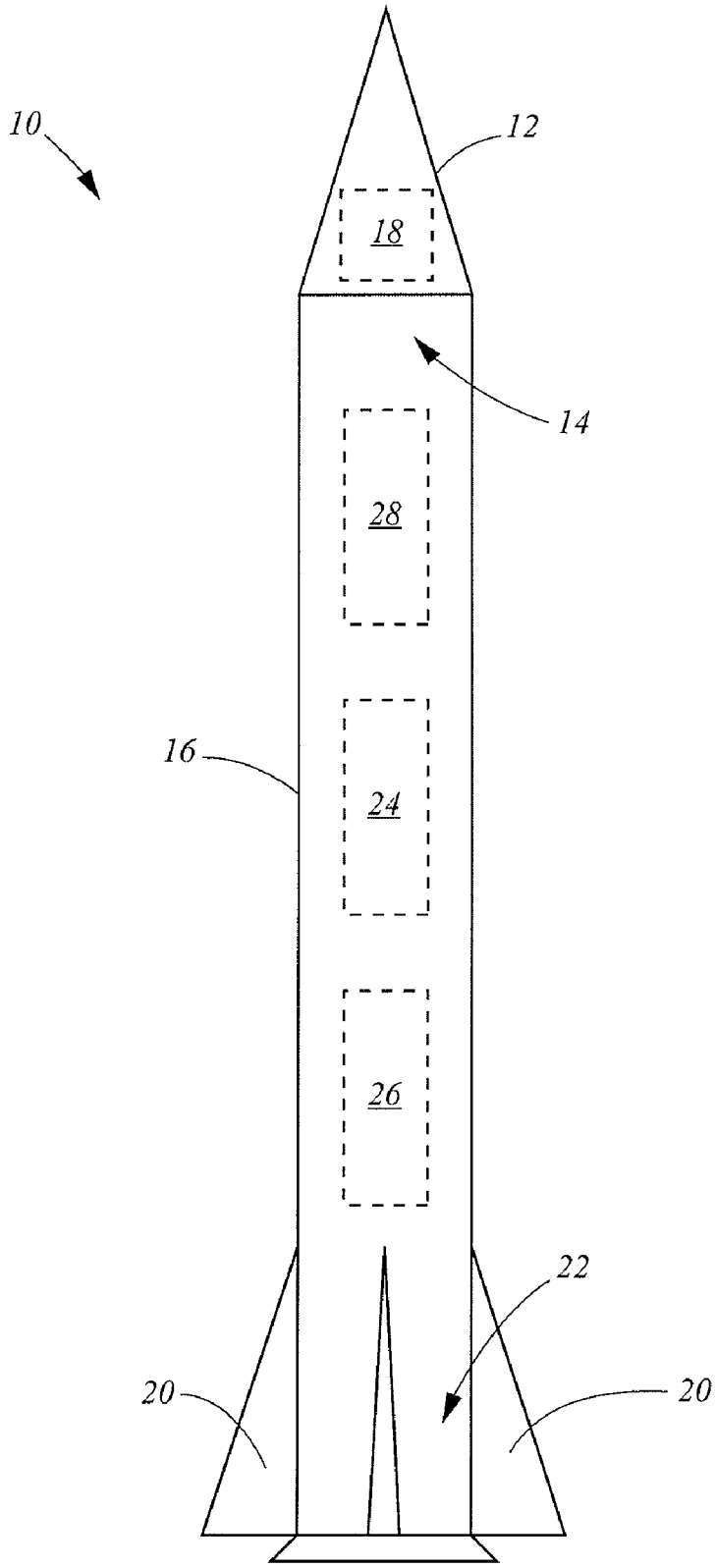
FIG. 1 is a side view of an embodiment of an aircraft of the present invention in the form of a missile.

An embodiment of an aircraft of the present invention is shown in FIG. 1. The aircraft shown in FIG. 1 is a missile 10 that includes a radome 12 on a forward end 14 of a fuselage body 16. The missile 10 also includes at least one antenna 18 enclosed within the radome 12 on the forward end 14 of the fuselage body 16. A plurality of fins 20 may be disposed at a rearward end 22 of the fuselage body 16, as shown in FIG. 1. Although not shown, additional fins, wings, and/or canards may be disposed anywhere along the fuselage body 16 for guiding the missile 10 through the air. The missile 10 may be designed and configured to carry a warhead 24 to a target using a propulsion system 26 and a targeting and guidance system 28. The antenna 18 may be part of the targeting and guidance system 28, and the targeting and guidance system 28 may be configured to control the propulsion system 26 in response to target and/or guidance information acquired using the antenna 18. Antennas 18, warheads 24, propulsion systems 26, and guidance and targeting systems 28 are known in the art and are schematically illustrated for purposes of simplifying FIG. 1.

The radome 12 may be designed, configured, and constructed to protect the antenna 18 from environmental conditions (e.g., wind, rain, dust, moisture, etc.) as the missile 10 travels through the air at high velocity toward an intended target.

Figure 2:
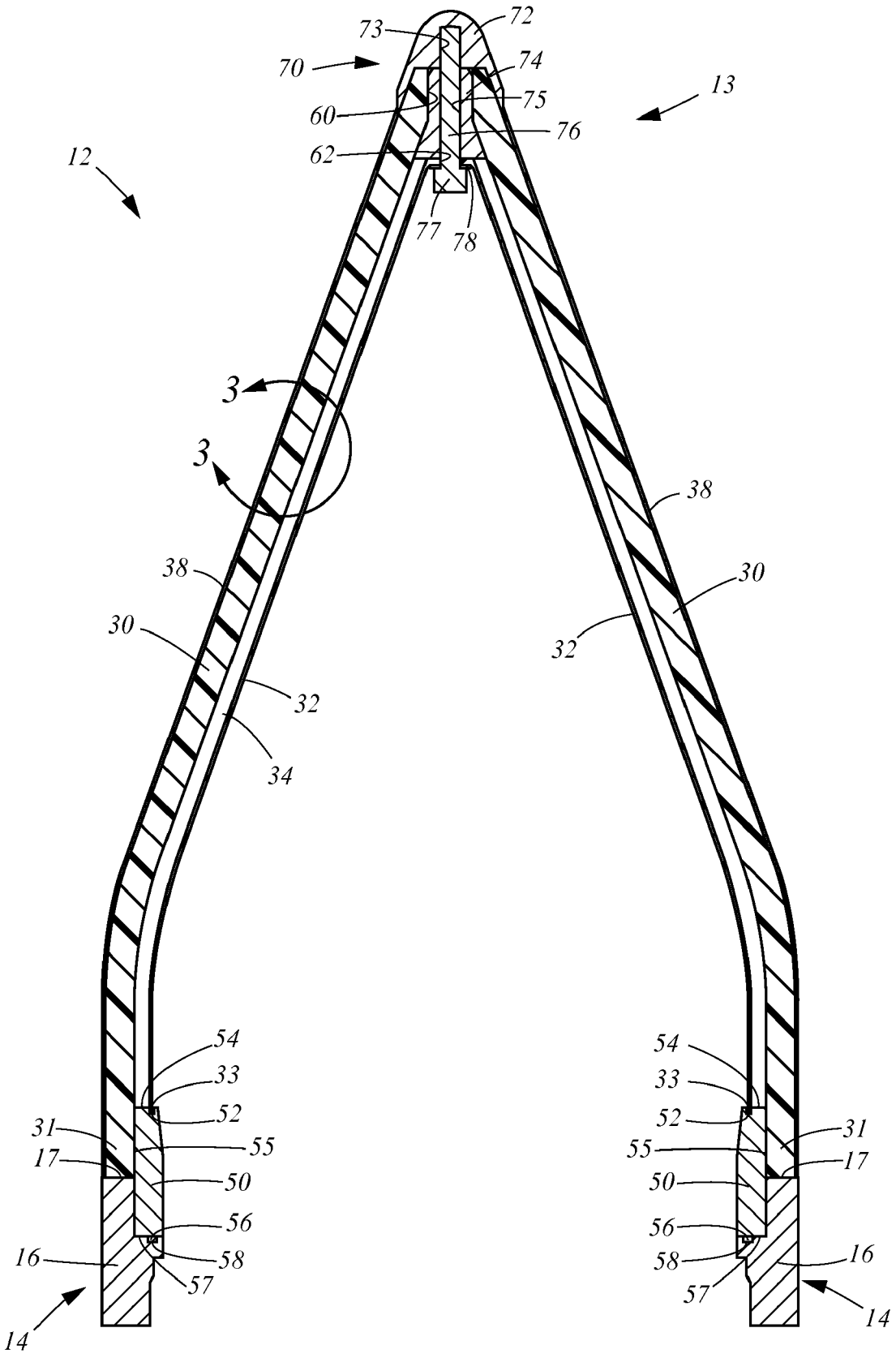
FIG. 2 is an enlarged view of a portion of the missile of FIG. 1 illustrating an embodiment of a radome of the present invention.

FIG. 2 is a cross-sectional view of a portion of a radome 12 of the present invention. As shown in FIG. 2, the radome 12 includes an outer wall 30 and an inner wall 32. At least major portions of the outer wall 30 and the inner wall 32 may be separated from one another by a space 34. The space 34 may be filled with air, a gas or mixture of gasses (e.g., an inert gas), a dielectric material (e.g., a polymeric foam, or a ceramic honeycomb structure), or a vacuum may be provided in the space 34. Thus, in some embodiments, a gap may be provided in the space 34. A coating 38 also may be disposed over outer surfaces of the outer wall 30.

Figure 3:
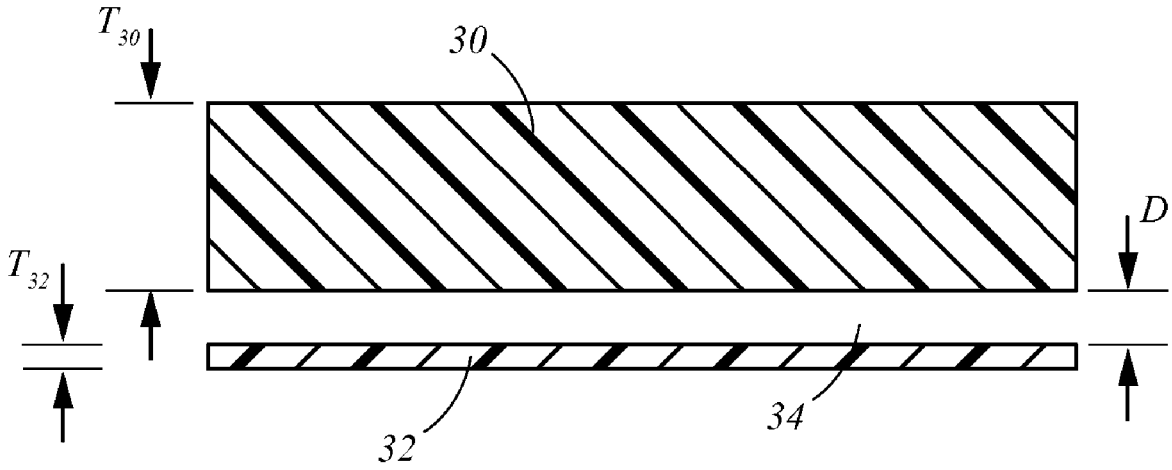
FIG. 3 is an enlarged cross-sectional view of a portion of a sidewall of the radome shown in FIGS. 1 and 2.

FIG. 3 is an enlarged cross-sectional view of the portions of the outer wall 30 and the inner wall 32 within Line 3-3 illustrated in FIG. 2.

The outer wall 30 and the inner wall 32 have different average electrical thicknesses. The electrical thickness $T_E$ of a material may be defined as the actual physical thickness $T_p$ of the material multiplied by the square root of the dielectric constant K (also referred to as the relative permittivity) of the material, as indicated in Equation 1 below:

$$T_E = T_P\sqrt{K} \qquad \text{Equation 1}$$

where $T_E$ is the electrical thickness of the material, $T_P$ is the actual physical thickness of the material, and K is the dielectric constant exhibited by the material.

Thus, in some embodiments, the outer wall 30 and the inner wall 32 have different average actual physical thicknesses (as well as different electrical thicknesses), as shown in FIG. 3. In other words, the outer wall 30 has a first average physical thickness $T_{30}$ and the inner wall 32 has an average physical thickness $T_{32}$ that differs from the average physical thickness $T_{30}$ of the outer wall 30. In some embodiments, the average physical thickness $T_{32}$ of the inner wall 32 may be less than the average thickness $T_{30}$ of the outer wall 30. By way of example and not limitation, the average physical thickness $T_{32}$ of the inner wall 32 may be about one-half (½) or less of the average physical thickness $T_{30}$ of the outer wall 30. More particularly, the average physical thickness $T_{32}$ of the inner wall 32 may be about one-quarter (¼) or less of the average physical thickness $T_{30}$ of the outer wall 30. In some embodiments, the outer wall 30 and the inner wall 32 have different average electrical thicknesses, and such embodiments may have similar or different physical thicknesses.

In some embodiments, it may be desirable to form the average physical thickness $T_{32}$ of the inner wall 32 to be physically as thin as possible while still having sufficient structural integrity to withstand the forces experienced by the average physical thickness $T_{32}$ of the inner wall 32 during flight of the missile 10 (FIG. 1). The average physical thickness $T_{32}$ of the inner wall 32 may be increased to meet structural requirements, although increasing the average physical thickness $T_{32}$ of the inner wall 32 may impact the electromagnetic performance of the inner wall 32 and the radome 12.

The average distance D between the outer wall 30 and the inner wall 32 in the space 34 may be about three-fourths (¾) or less of the average physical thickness $T_{30}$ of the outer wall 30. More particularly, the average distance D between the outer wall 30 and the inner wall 32 in the space 34 may be about two-thirds (⅔) or less of the average physical thickness $T_{30}$ of the outer wall 30.

By way of example and not limitation, the average electrical thickness of the outer wall 30 may be about $N\lambda_O/2$, where N is an integer (e.g., 1 or 2) and $\lambda_O$ is the wavelength of the electromagnetic radiation in the material of the outer wall 30 at the center of the desired range of operating wavelengths, and the average electrical thickness of the inner wall 32 may be about $\lambda_I/8$ or less, where $\lambda_I$ is the wavelength of the electromagnetic radiation in the material of the inner wall 32 at the center of the desired range of operating wavelengths. In such embodiments, the average electrical thickness of the space 34 between the outer wall 30 and the inner wall 32 may be between about $\lambda_S/5$ and $\lambda_S/10$, where $\lambda_S$ is the wavelength of the electromagnetic radiation in the space 34 at the center of the desired range of operating wavelengths. The average electrical thickness of the outer wall 30, as well as the average electrical thickness of the space 34 between the outer wall 30 and the inner wall 32, may be increased to compensate for non-normal incidence of the radiating fields.

In some embodiments, one or more of the average physical thickness $T_{30}$ of the outer wall 30, the average physical thickness $T_{32}$ of the inner wall 32, and the average distance D between the outer wall 30 and the inner wall 32 in the space 34 may be at least substantially uniform over the major portions thereof, as shown in FIG. 2. In other embodiments, one or more of the average physical thickness $T_{30}$ of the outer wall 30, the average physical thickness $T_{32}$ of the inner wall 32, and the average distance D between the outer wall 30 and the inner wall 32 in the space 34 may vary in a predetermined, selected manner over the major portions thereof to provide desired transmission characteristics to the radome 12 with respect to electromagnetic radiation transmitting through the radome 12 to and/or from the antenna 18 (FIG. 1). Intentionally varying such thicknesses and distances produces what is known in the art as a "prescription radome."

Referring again to FIG. 2, in the embodiment shown therein, the radome 12 and, hence, each of the outer wall 30 and the inner wall 32, has a generally frustoconical dome shape. Thus, the outer wall 30 and the inner wall 32 have substantially similar shapes. The inner wall 32 has a smaller overall size than the outer wall 30 to allow the inner wall 32 to be surrounded by and disposed within an inner dome area of the outer wall 32.

The outer wall 30 may comprise a ceramic matrix composite (CMC) material having a ceramic matrix phase. A reinforcing phase may be distributed throughout the ceramic matrix phase. The ceramic matrix phase may comprise a ceramic oxide material such as, for example, magnesium oxide (MgO), aluminum oxide ($Al_2O_3$), silicon oxide ($SiO_2$), zirconium oxide ($ZrO_2$), titanium oxide ($TiO_2$), yttrium oxide ($Y_2O_3$), a combination of such oxides (e.g., aluminosilicate ($Al_2SiO_5$) or mullite), etc. The reinforcing phase may comprise, for example, fibers, particles, and/or whiskers distributed throughout the ceramic matrix phase. In some embodiments, the reinforcing phase may comprise a fabric comprising woven fibers. The reinforcing phase may also comprise a ceramic material. In some embodiments, the reinforcing phase may also comprise a ceramic oxide material such as, for example, magnesium oxide (MgO), aluminum oxide ($Al_2O_3$), silicon oxide ($SiO_2$), zirconium oxide ($ZrO_2$), titanium oxide ($TiO_2$), yttrium oxide ($Y_2O_3$), a combination of such oxides (e.g., aluminosilicate ($Al_2SiO_5$) or mullite), etc. In some embodiments, the ceramic matrix phase and the reinforcing phase may have at least substantially similar chemical compositions. In further embodiments, the ceramic matrix phase and the reinforcing phase may have different chemical compositions.

As a non-limiting embodiment, the ceramic matrix phase may comprise an aluminosilicate ($Al_2SiO_5$) material, and the reinforcing phase may comprise a fabric of woven aluminosilicate ($Al_2SiO_5$) fibers. An example of a suitable, commercially available fabric of aluminosilicate fibers is sold by 3M of St. Paul, Minn. under the trade name NEXTEL® 312.

In some embodiments, the inner wall 32 may comprise a ceramic matrix composite (CMC) material having a ceramic matrix phase as previously described herein in relation to the outer wall 30.

In some applications, the inner wall 32 may be subjected to relatively lower temperatures (e.g., temperatures below about 450° Celsius). In such applications, the inner wall 32 may comprise a high-temperature organic matrix composite material including a polymeric matrix phase and a reinforcing phase. The reinforcing phase may comprise, for example, a fabric, fibers, particles, and/or whiskers distributed throughout the polymeric matrix phase.

The matrix phase may comprise a thermosetting polymer material, or the matrix phase may comprise a thermoplastic polymer material. In embodiments in which the matrix phase comprises a thermoset polymer material, the matrix phase may be thermally stable (i.e., will not physically degrade, decompose, or combust in any significant detrimental manner) up to temperatures of about 450° Celsius or more. In embodiments in which the matrix phase comprises a thermoplastic polymer material, the matrix phase may exhibit a glass transition temperature of about 450° Celsius or higher.

As non-limiting examples, the matrix phase in such organic matrix composite materials may comprise a cyanate-based polymeric material (e.g., a cyanate ester material) or a polyimide-based polymeric material, and the reinforcing phase may comprise quartz fabric, fibers, particles, and/or whiskers.

Other materials also may be used to form the outer wall 30 and the inner wall 32, provided the materials impart physical properties to the outer wall 30 and the inner wall 32, respectively, that will allow the outer wall 30 and the inner wall 32 to sufficiently protect the antenna 18 from the environmental conditions to which the outer wall 30 and the inner wall 32 will be exposed, and at the temperatures to which the outer wall 30 and the inner wall 32 may be heated, for example, during flight of a missile 10 (FIG. 1).

With continued reference to FIG. 2, the coating 38 over outer surfaces of the outer wall 30 may be used to hermetically seal the outer surface of the outer wall 30, as the outer wall 30 may comprise some level of porosity, and/or to improve the hardness and durability of the outer surface of the outer wall 30. The coating 38 may comprise a glass frit material. Glass frit materials are commercially available. By way of example and not limitation, the coating 38 may comprise a eutectic composition of magnesium oxide, aluminum oxide, and silicon oxide such as the glass frit sold by PEMCO International of Leesburg, Ala. under the product number P-941. In additional embodiments, the coating 38 may comprise the glass frit sold by Ferro Corporation of Cleveland, Ohio under the product number CC257, or the glass frit sold by Ferro Corporation under the product number 3249. In yet further embodiments, the coating 38 may comprise aluminum oxide ($Al_2O_3$), silicon oxide ($SiO_2$), yttrium oxide ($Y_2O_3$), pyrophyllite (aluminum silicate hydroxide ($AlSi_2O_5OH$)), kaolinite ($Al_2Si_2O_5(OH)_4$), nepheline syenite, mixtures of one or more such materials, or another ceramic (e.g., glass) material.

The particular chemical composition of the outer wall 30, the inner wall 32, and any matter within the space 34, as well as the particular dimensions of the outer wall 30 and the inner wall 32, and the distance therebetween within the space 34, will vary depending on the particular application in which the radome 12 is to be used and the range of frequencies of electromagnetic radiation that are to be transmitted through the radome 12. In some embodiments, the radome 12 may be operational over a broad range of frequencies. For example, the radome 12 may be configured to exhibit an average insertion loss for a typical missile radome shape of less than about −1.5 dB, or even less than about −0.5 dB, for 15° to 45° scan angles in principal planes over a range of frequencies of electromagnetic radiation extending from a first frequency to a second frequency that is about 1.4 times the first frequency, when the electromagnetic radiation is emitted from an antenna 18 (FIG. 1) disposed within the radome 12.

A non-limiting example of a method that may be used to form a radome 12 is described herein below.

Generally, the outer wall 30 and the inner wall 32 may be separately formed from one another, assembled together, and attached to an aircraft, spacecraft, or another device or apparatus carrying an antenna. For example, if the outer wall 30 and the inner wall 32 have a dome shape, the outer wall 30 and the inner wall 32 may be separately formed, the inner wall 32 may be inserted at least partially into an inner dome area of the outer wall 30, and the inner wall 32 and the outer wall 30 may be coupled together in such a manner as to provide a space 34 between at least a major portion of the outer wall 30 and at least a major portion of the inner wall 32.

The outer wall 30 may comprise a ceramic matrix composite (CMC) material, and may be fabricated using methods similar those known in the art such as, for example, those disclosed in U.S. Pat. No. 4,983,422 to Davis et al., issued Jan. 8, 1991, U.S. Pat. No. 5,395,648 to Davis et al., issued Mar. 7, 1995, and U.S. Pat. No. 6,497,776 to Butler et al., issued Dec. 24, 2002. If the inner wall 32 also includes a ceramic matrix composite material, as previously discussed herein, the inner wall 32 also may be formed using such methods.

The outer wall 30 (and optionally, the inner wall 32) may be formed by introducing a liquid ceramic matrix precursor material into a reinforcement ceramic structure or ceramic material (e.g., fabric, fibers, particles, and/or whiskers), curing the resulting structure to set the desired geometry, and sintering the cured structure to a desired final density.

In some embodiments, a reinforcement ceramic structure may be formed using a two-dimensional or three-dimensional reinforcement fabric, which may be produced by weaving reinforcement strands (e.g., single fibers or yarns) in a desirable pattern. A number of different techniques may be used to form a reinforcement structure from reinforcement strands, including two-dimensional and three-dimensional weaving techniques, filament winding techniques, tape wrapping techniques, etc. Reinforcement fabrics are also commercially available, such as, for example, the aluminosilicate fiber fabric sold by 3M of St. Paul, Minn., under the trade name NEXTEL® 312, as previously mentioned.

Liquid ceramic matrix precursor material may be introduced into the reinforcement structure or material before and/or after shaping the reinforcement structure or material in a desired shape corresponding to that of the outer wall 30 to be formed therefrom. For example, a reinforcement fabric may be pre-impregnated with the liquid ceramic matrix precursor material prior to shaping the pre-impregnated reinforcement fabric into a shape corresponding to the outer wall 30.

The ceramic matrix precursor material may comprise a slurry that includes ceramic particles suspended in a liquid medium. The liquid medium may comprise, for example, water, an alcohol (e.g., ethylene glycol), or a mixture thereof. The ceramic particles comprise material or materials that will form the ceramic matrix phase of the resulting ceramic matrix composite material. The ceramic particles may comprise, for example, from about 20% to about 80% of the slurry by weight. Other additives may be included in the slurry to assist in processing such as, for example, polymeric curing agents, binders, lubricants, dispersants, etc.

After introducing the liquid ceramic matrix precursor material into the reinforcement ceramic structure or ceramic material (e.g., fabric, fibers, particles, and/or whiskers) and shaping the resulting impregnated reinforcement structure into a shape corresponding to the desired shape of the outer wall 30 to be formed therefrom, the impregnated reinforcement structure may be treated to set the desired geometry of the impregnated reinforcement structure.

For example, in some embodiments, the slurry may comprise a polymer precursor material that may be cured to cause the polymer precursor material to polymerize in such a manner as to form a solid three-dimensional structure. In such embodiments, the impregnated reinforcement structure may be heated in order to cure the polymer precursor material and set the geometry of the impregnated reinforcement structure. The curing may also drive off liquids and other volatile components of the slurry. By way of example, the impregnated reinforcement structure may be cured by slowly ramping up the temperature of the impregnated reinforcement structure in a furnace to a curing temperature of between about 125° Celsius and about 200° Celsius (e.g., about 177° Celsius) over a time period of between about twelve (12) hours and about thirty-six (36) hours. The temperature then may be held at the curing temperature for a time period of between about six (6) hours and about twelve (12) hours.

In some embodiments, the impregnated reinforcement structure may be cured while disposed in a bag in which a vacuum is drawn in order to cause the bag to conform to the shape of the impregnated reinforcement structure. In other embodiments, the impregnated reinforcement structure may be cured in a hot press or an autoclave.

After curing the impregnated reinforcement structure, the resulting cured but unsintered structure may be sintered in a furnace to form the outer wall 30 including a ceramic matrix composite material that includes a reinforcing phase disposed within a ceramic matrix phase.

In some embodiments, the cured structure may be sintered in an oxidizing atmosphere (i.e., in an atmosphere including oxygen) such as, for example, in air. In such embodiments, the ceramic particles of the ceramic matrix precursor material may oxidize during sintering to form an oxide material, which may form at least a portion of the ceramic matrix phase in the resulting ceramic matrix composite material of the outer wall 30.

During a sintering process, the temperature may be raised in a stepped profile from room temperature to a maximum sintering temperature over a period of from about six (6) hours to about twelve (12) hours. The temperature in the furnace may be held at the maximum sintering temperature for between about two (2) and about ten (10) hours. The maximum sintering temperature may be above about 800° Celsius. Additional sintering cycles may be performed as necessary or desirable in order to increase the density and/or strength of the outer wall 30.

After sintering, final machining (e.g., grinding, milling, drilling, etc.) and/or other shape-forming processes may be used to ensure that the outer wall 30 (and, optionally, the inner wall 32) has the appropriate final dimensions.

The above-described method is set forth merely as one example of a method that may be used to form the outer wall 30 (and, optionally, the inner wall 32) and other methods may also be employed in embodiments of the present invention. For example, filament winding techniques may be used to form a green (i.e., unsintered) outer wall, and the green outer wall may be sintered to a desirable final density to form the outer wall 30. Furthermore, in additional embodiments, a green outer wall may be formed without employing a curing process, and the uncured, green outer wall may be sintered to a desirable final density to form the outer wall 30.

The coating 38 may be applied to outer surfaces of the outer wall 30 after forming the outer wall 30, as previously described herein, using, for example, a spray-coating process.

A slurry may be formed that includes a liquid medium in which particles of the ceramic material (e.g., glass) that will ultimately form the coating 38 are suspended. The liquid medium may comprise, for example, water, glycerin, an alcohol (e.g., ethylene glycol), or a mixture thereof. The slurry may also include processing aids such as, for example, binders, deflocculants, wetting agents, etc. The slurry may be sprayed onto the outer surfaces of the outer wall 30, after which the slurry is allowed to dry, leaving behind the particles of the ceramic material (e.g., glass) that will ultimately form the coating 38 on the outer surfaces of the outer wall 30. The outer wall 30 then may be heated in a furnace to sinter the particles and form the coating 38 on the outer wall 30.

After forming the outer wall 30 and the inner wall 32, the outer wall 30 and the inner wall 32 may be assembled together and attached to the aircraft or spacecraft to which the radome 12 (FIG. 1) is to be attached. For example, in the embodiment of FIGS. 1 and 2, the outer wall 30 and the inner wall 32 may be attached to the fuselage body 16 at the forward end 14 thereof using a mounting ring 50, as shown in FIG. 2. Each of the outer wall 30 and the inner wall 32 may be attached to the mounting ring 50, and the mounting ring 50 may be attached to the fuselage body 16. The outer wall 30 and the inner wall 32 may be attached to the mounting ring 50 using, for example, one or more of an adhesive, bolts, screws, rivets, etc. The mounting ring 50 may be similarly attached to the fuselage body 16 using, for example, one or more of an adhesive, bolts, screws, rivets, etc.

With continued reference to FIG. 2, an end 33 of the inner wall 32 may be inserted into a complementary annular recess 52 formed in a forward end surface 54 of the mounting ring 50. The annular recess 52 may have a shape complementary to that of the end 33 of the inner wall 32. An adhesive may be disposed between the end 33 of the inner wall 32 and the mounting ring 50 within the annular recess 52 to at least partially secure the inner wall 32 to the mounting ring 50.

An end 31 of the outer wall 30 may be disposed adjacent a radially outer surface 55 of the mounting ring 50 and a forward end surface 17 of the fuselage body 16, as shown in FIG. 2. An adhesive may be disposed between the end 31 of the outer wall 30 and the radially outer surface 55 of the mounting ring 50 to at least partially secure the outer wall 30 to the mounting ring 50. In additional embodiments, bolts, screws, and/or rivets may be used to attach the end 31 of the outer wall 30 to the radially outer surface 55 of the mounting ring 50. Optionally, an adhesive may be disposed between the end 31 of the outer wall 30 and the forward end surface 17 of the fuselage body 16 to at least partially secure the outer wall 30 to the fuselage body 16.

As previously mentioned, the mounting ring 50 may be similarly attached to the fuselage body 16 using, for example, one or more of an adhesive, bolts, screws, rivets, etc. Complementary features may be provided on the mounting ring 50 and the fuselage body 16 to ensure that the mounting ring 50 is properly positioned with respect to the fuselage body 16 when it is attached thereto. Furthermore, a sealing member 56 (e.g., an O-ring) may be disposed in an annular recess 58 formed on a rearward end surface 57 of the mounting ring 50. The sealing member 56 may be used to provide a hermetic seal between the fuselage body 16 and the mounting ring 50. In this configuration, the mounting ring 50 may be positioned on the fuselage body 16 such that an annular ridge on the rearward end surface 57 of the mounting ring 50 is disposed within the annular recess 58 in an adjacent surface of the fuselage body 16, and the mounting ring 50 may be attached to the fuselage body 16 using, for example, one or more of an adhesive, bolts, screws, rivets, etc.

In some embodiments, the outer wall 30 may be coupled to the inner wall 32 at a forward end 13 of the radome 12. By way of example and not limitation, a nose assembly 70 may be coupled to the inner wall 32 at a forward end 13 of the radome 12, as shown in FIG. 2. An aperture 60 may be formed through the outer wall 30, and a similar aperture 62 may be formed through the inner wall 32, at the forward end 13 of the radome 12. The aperture 60 in the outer wall 30 and the aperture 62 in the inner wall 32 may be formed by drilling through the outer wall 30 and the inner wall 32. In other embodiments, the outer wall 30 may be formed in such a manner as to provide the aperture 60 therein, and the inner wall 32 may be formed in such a manner as to provide the aperture 62 therein, such that no drilling or other process is required to form the apertures 60, 62 through the outer wall 30 and the inner wall 32, respectively, after forming the outer wall 30 and the inner wall 32.

The nose assembly 70 shown in FIG. 2 includes a cap 72, an insert 74, and a bolt 76 that extends through the insert 74 and engages the cap 72 to secure the various components of the nose assembly 70 together. The cap 72, insert 74, and bolt 76 may comprise a metal, ceramic, or a composite material that exhibits physical properties (e.g., strength, toughness, hardness, etc.) sufficient to withstand the forces and conditions to which they will be exposed during flight of the missile 10 (FIG. 1) at the temperatures to which they may be heated during flight of the missile 10.

The cap 72 is positioned on an exterior surface of the outer wall 30 at the forward end 13 of the radome 12. The cap 72 has a hole 73 that extends at least partially therethrough that is configured to receive the bolt 76 at least partially therein, as shown in FIG. 2.

The insert 74 is disposed between the outer wall 30 and the inner wall 32 at the forward end 13 of the radome 12. The insert 74 has a generally cylindrical shape, and a hole 75 that is configured to receive the bolt 76 therethrough, extending longitudinally through the insert 74. A forward end of the insert 74 may be substantially cylindrical, and a cylindrical side surface of the insert 74 may have a diameter substantially equal to, but slightly less than, the diameter of the aperture 60 extending through the outer wall 30, such that the substantially cylindrical portion of the insert 74 may be inserted into and received within the aperture 60, as shown in FIG. 2. A side surface of a rearward portion of the insert 74 may have a generally frustoconical shape that is complementary to the frustoconical shape of an adjacent inner surface of the outer wall 30, as shown in FIG. 2. The frustoconical rearward portion of the insert 74 prevents the insert 74 from passing through the aperture 60 in the outer wall 30.

A washer 78 may be provided adjacent an inner surface of the inner wall 32 on a side thereof opposite the insert 74. The washer 78 may be used to disperse forces applied to the inner wall 32 by a head 77 of the bolt 76 over a greater surface area of the inner wall 32.

As shown in FIG. 2, the bolt 76 extends through the washer 78, the aperture 62 in the inner wall 32, the hole 75 in the insert 74, the aperture 60 in the outer wall 30, and into the hole 73 in the cap 72. Although not shown, the bolt 76 may be threaded, and complementary threads may be provided at least in the hole 73 of the cap 72 such that the threads of the bolt 76 may be engaged with the threads of the cap 72 to secure the various components of the nose assembly 70 together. An inner surface of the insert 74 within the hole 75 also may be threaded to engage the threads of the bolt 76.

Although not shown in FIG. 2, sealing members such as, for example, gaskets and O-rings, may be provided between the outer wall 30, the inner wall 32, and the various components of the nose assembly 70 to provide an air-tight hermetic seal therebetween, such that gases cannot flow into, or out from, a space 34 between the outer wall 30 and the inner wall 32, and such that gases cannot flow into, or out from, the interior of the radome 12.

Coupling the outer wall 30 to the inner wall 32 at the forward end 13 of the radome 12 may provide additional stability and strength to the radome 12.

Figure 4:
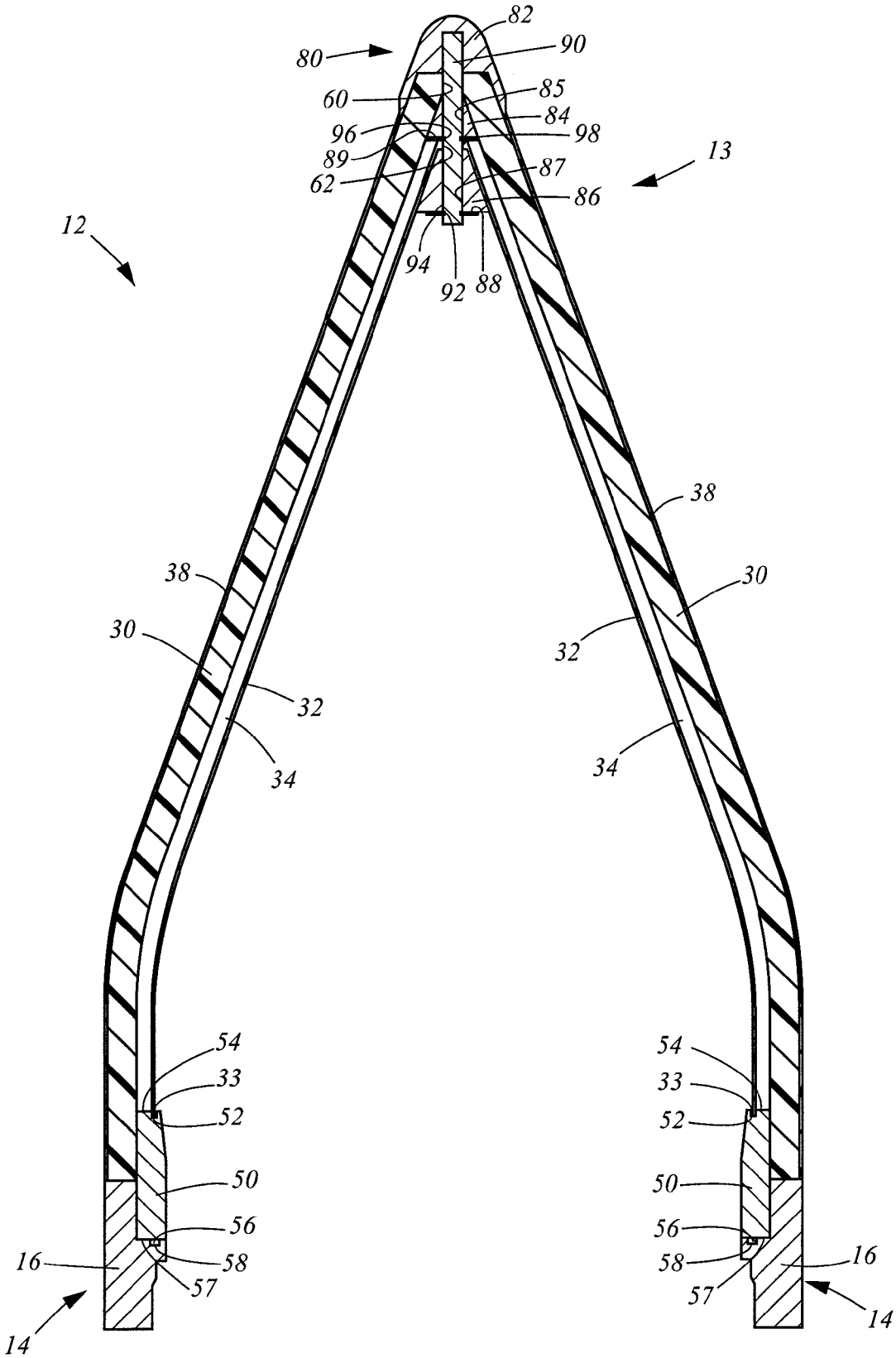
FIG. 4 is an enlarged view like that of FIG. 2 illustrating additional methods and devices that may be used to couple together components of a radome.

Another embodiment of a nose assembly 80 that may be used to couple the outer wall 30 to the inner wall 32 at the forward end 13 of the radome 12 is illustrated in FIG. 4. The nose assembly 80 shown in FIG. 4 includes a cap 82, a first insert 84, a second insert 86, and a rod 90 that extends from the cap 82, through the first insert 84, and through the second insert 86. In the embodiment of FIG. 4, however, a snap fit is provided between various components of the nose assembly 80 to secure the various components of the nose assembly 80 together.

As in the nose assembly 70 of FIG. 2, the various components of the nose assembly 80 of FIG. 4 may comprise a metal, ceramic, or a composite material that exhibits physical properties (e.g., strength, toughness, hardness, etc.) sufficient to withstand the forces and conditions to which they will be exposed during flight of the missile 10 (FIG. 1) at the temperatures to which they may be heated during flight of the missile 10.

The cap 82 is positioned on an exterior surface of the outer wall 30 at the forward end 13 of the radome 12. The rod 90 extends from the cap 82, as shown in FIG. 4. In some embodiments, the rod 90 may be attached to the cap 82 using, for example, at least one of complementary threads, an adhesive, a weld, etc. In other embodiments, the rod 90 may be integrally formed with the cap 82.

The first insert 84 is disposed between the outer wall 30 and the inner wall 32 at the forward end 13 of the radome 12. The first insert 84 has a generally cylindrical shape, and a hole 85 that is configured to receive the rod 90 therethrough, extending longitudinally through the first insert 84. A side surface of the first insert 84 may have a generally frustoconical shape that is complementary to the frustoconical shape of an adjacent inner surface of the outer wall 30, as shown in FIG. 4. The frustoconical shape of the first insert 84 prevents the insert 84 from passing through the aperture 60 in the outer wall 30.

The second insert 86 is disposed adjacent an inner surface of the inner wall 32 at the forward end 13 of the radome 12. The second insert 86 also has a generally cylindrical shape, and a hole 87 that is configured to receive the rod 90 therethrough, extending longitudinally through the second insert 86. A side surface of the second insert 86 may have a generally frustoconical shape that is complementary to the frustoconical shape of an adjacent inner surface of the inner wall 32, as shown in FIG. 4. The frustoconical shape of the second insert 86 prevents the insert 86 from passing through the aperture 62 in the inner wall 32.

One or more annular grooves may be formed circumferentially about the rod 90 in the cylindrical side surface thereof, and snap rings may be snap-fitted into the annular grooves. For example, a first annular groove 92 may be formed circumferentially about the rod 90 in the cylindrical side surface thereof proximate a rearward surface 88 of the second insert 86, and a first snap ring 94 may be snap-fitted into the first annular groove 92 to hold the second insert 86 (and, additionally, the inner wall 32, first insert 84, and outer wall 30) in position relative to the rod 90 and the cap 82. Optionally, a second annular groove 96 may be formed circumferentially about the rod 90 in the cylindrical side surface thereof proximate a rearward surface 85 of 89 of the first insert 84, and a second snap ring 98 may be snap-fitted into the second annular groove 96 to provide additional support to the first insert 84 (and, additionally, the outer wall 30) for holding the first insert 84 in position relative to the rod 90 and the cap 82.

Washers (not shown in FIG. 4) also may be provided between various components of the nose assembly 80 as necessary or desirable.

Although not shown in FIG. 4, sealing members such as, for example, gaskets and O-rings, may be provided between the outer wall 30, the inner wall 32, and the various components of the nose assembly 80 to provide an air-tight hermetic seal therebetween, such that gases cannot flow into, or out from, a space 34 between the outer wall 30 and the inner wall 32, and such that gases cannot flow into, or out from, the interior of the radome 12.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the scope of the invention as defined by the following appended claims and their legal equivalents.

What is claimed is:

1. A radome comprising:

an outer wall comprising a layer of ceramic matrix composite (CMC) material having a first average physical thickness; and an inner wall comprising a layer of material having a second average physical thickness differing from the first average physical thickness, the inner wall having a shape similar to a shape of the outer wall, at least a major portion of the inner wall separated from at least a major portion of the outer wall by a space between the inner wall and the outer wall.

2. The radome of claim 1, wherein each of the outer wall and the inner wall comprises a dome, and wherein at least a portion of the inner wall is disposed within the dome of the outer wall.

3. The radome of claim 2, wherein the space between the outer wall and the inner wall is at least substantially uniform.

4. The radome of claim 3, wherein a physical thickness of the outer wall is at least substantially uniform.

5. The radome of claim 4, wherein a physical thickness of the inner wall is at least substantially uniform.

6. The radome of claim 1, wherein the second average physical thickness of the inner wall is about one-fourth (¼) or less of the first average physical thickness of the outer wall.

7. The radome of claim 6, wherein the space has an average physical thickness about two-thirds (⅔) or less of the first average physical thickness of the outer wall.

8. The radome of claim 1, further comprising a frit coating on at least a portion of an exterior surface of the outer wall.

9. The radome of claim 1, wherein the ceramic matrix composite material comprises:

a ceramic matrix phase; and a reinforcement phase comprising at least one of a plurality of fibers, a plurality of whiskers, and a plurality of particles dispersed throughout the ceramic matrix phase.

10. The radome of claim 9, wherein the ceramic matrix composite material comprises a plurality of fibers arranged in a fabric, the fabric disposed within the ceramic matrix phase.

11. The radome of claim 9, wherein the ceramic matrix phase comprises at least one of an oxide material, aluminum silicate, and mullite.

12. The radome of claim 11, wherein the ceramic matrix phase comprises an oxide material selected from the group consisting of magnesium oxide (MgO), aluminum oxide ($Al_2O_3$), silicon oxide ($SiO_2$), zirconium oxide ($ZrO_2$), titanium oxide ($TiO_2$), and yttrium oxide ($Y_2O_3$).

13. The radome of claim 12, wherein the reinforcement phase comprises a ceramic material.

14. The radome of claim 13, wherein the ceramic material comprises aluminum silicate.

15. The radome of claim 1, wherein the inner wall comprises a layer of ceramic matrix composite (CMC) material having a material composition at least substantially similar to a material composition of the ceramic matrix composite material of the outer wall.

16. The radome of claim 1, wherein the inner wall comprises a layer of organic matrix composite material comprising:

a polymer matrix phase; and a reinforcement phase comprising at least one of a plurality of fibers, a plurality of whiskers, and a plurality of particles dispersed throughout the polymer matrix phase.

17. The radome of claim 16, wherein the polymer matrix phase exhibits a glass transition temperature greater than about 850° F. (454° C.).

18. The radome of claim 1, further comprising at least one of air, nitrogen, and an inert gas within the space.

19. The radome of claim 18, wherein the space is hermetically sealed.

20. The radome of claim 1, wherein the radome exhibits an average insertion loss of less than about −1.5 dB for scan angles between about 15° and about 45° over a range of frequencies of electromagnetic radiation extending from a first frequency to a second frequency when the electromagnetic radiation is emitted from an antenna disposed within the radome, the second frequency being about 1.4 times the first frequency.

21. The radome of claim 1, wherein a first average electrical thickness of the outer wall is equal to about one-half (½) of an integer multiple of a wavelength of electromagnetic radiation in the outer wall at a center of a desired range of operating wavelengths, a second average electrical thickness of the inner wall is equal to about one-eighth (⅛) of a wavelength of electromagnetic radiation in the inner wall at the center of the desired range of operating wavelengths, and an average electrical thickness of the space between the outer wall and the inner wall is between about one-fifth (⅕) and about one-tenth (1/10) of a wavelength of electromagnetic radiation in the space at the center of the desired range of operating wavelengths.

22. An aircraft or spacecraft comprising:

an antenna for emitting electromagnetic radiation over a range of frequencies of electromagnetic radiation extending from a first frequency to a second frequency; and a radome at least partially covering the antenna, the radome comprising:

an outer wall comprising a layer of ceramic matrix composite (CMC) material having a first average physical thickness; and an inner wall comprising a layer of material having a second average physical thickness differing from the first average physical thickness, the inner wall having a shape similar to a shape of the outer wall, at least a major portion of the inner wall separated from at least a major portion of the outer wall by a space between the inner wall and the outer wall.

23. The aircraft or spacecraft of claim 22, wherein the aircraft or spacecraft comprises at least one of a missile and an aircraft.

24. The aircraft or spacecraft of claim 22, wherein the second frequency is about 1.4 times the first frequency.

25. The aircraft or spacecraft of claim 22, wherein the radome exhibits an average power insertion loss of less than about −1.5 dB for scan angles between about 15° and about 45° over the range of frequencies when the electromagnetic radiation is emitted by the antenna.

26. A method of forming a radome, comprising:

forming a dome-shaped outer wall having a first average physical thickness and comprising a ceramic matrix composite (CMC) material;

forming a dome-shaped inner wall having a second average physical thickness differing from the first average physical thickness;

inserting the inner wall at least partially into an area enclosed by the outer wall; and coupling the inner wall to the outer wall and providing a space between at least a major portion of the outer wall and at least a major portion of the inner wall.

27. The method of claim 26, further comprising configuring the outer wall and the inner wall to provide an at least substantially uniform distance between the inner wall and the outer wall when the inner wall is coupled to the outer wall.

28. The method of claim 27, further comprising forming the outer wall to have an at least substantially uniform physical thickness.

29. The method of claim 28, further comprising forming the inner wall to have an at least substantially uniform physical thickness.

30. The method of claim 26, further comprising selecting the second average physical thickness of the inner wall to be about one-fourth (¼) or less of the first average physical thickness of the outer wall.

31. The method of claim 30, further comprising configuring the outer wall and the inner wall to cause the average distance between the outer wall and the inner wall to be about two-thirds (⅔) or less of the first average physical thickness of the outer wall.

32. The method of claim 26, further comprising forming a frit coating on at least a portion of an exterior surface of the outer wall.

33. The method of claim 26, wherein forming the dome-shaped outer wall comprising the ceramic matrix composite material comprises dispersing a reinforcement phase comprising at least one of a plurality of fibers, a plurality of whiskers, and a plurality of particles throughout a ceramic matrix phase to form the ceramic matrix composite material.

34. The method of claim 33, wherein dispersing the reinforcement phase throughout the ceramic matrix phase comprises embedding a fabric comprising a plurality of fibers within the ceramic matrix phase.

35. The method of claim 34, further comprising selecting the ceramic matrix phase to comprise at least one of an oxide material, aluminum silicate, and mullite.

36. The method of claim 35, further comprising selecting the ceramic matrix phase to comprise an oxide material selected from the group consisting of magnesium oxide (MgO), aluminum oxide ($Al_2O_3$), silicon oxide ($SiO_2$), zirconium oxide ($ZrO_2$), titanium oxide ($TiO_2$), and yttrium oxide ($Y_2O_3$).

37. The method of claim 35, further comprising selecting the reinforcement phase to comprise a ceramic material.

38. The method of claim 37, further comprising selecting the reinforcement phase to comprise aluminum silicate.

39. The method of claim 26, wherein forming a dome-shaped inner wall comprises forming the inner wall to comprise a layer of ceramic matrix composite (CMC) material.

40. The method of claim 39, further comprising selecting the ceramic matrix composite material of the inner wall to have a material composition at least substantially similar to a material composition of the ceramic matrix composite material of the outer wall.

41. The method of claim 26, wherein forming the dome-shaped inner wall comprises dispersing a reinforcement phase comprising at least one of a plurality of fibers, a plurality of whiskers, and a plurality of particles throughout a polymer matrix phase to form an organic matrix composite material of the inner wall.

42. The method of claim 41, further comprising selecting the polymer matrix phase to comprise a polymer material exhibiting a glass transition temperature greater than about 850° F. (454° C.).

43. The method of claim 26, further comprising providing at least one of air, nitrogen, and an inert gas within the space.

44. The method of claim 43, further comprising hermetically sealing the space.

45. The method of claim 26, further comprising configuring the radome to exhibit an average insertion loss of less than about −1.5 dB for scan angles between about 15° and about 45° over a range of frequencies of electromagnetic radiation extending from a first frequency to a second frequency when the electromagnetic radiation is emitted from an antenna disposed within the radome, the second frequency being about 1.4 times the first frequency.

* * * * *